US011148014B2

(12) United States Patent
Molinari et al.

(10) Patent No.: US 11,148,014 B2
(45) **Date of Patent: *Oct. 19, 2021**

(54) SPORTS BALL

(71) Applicant: NIKE, Inc., Beaverton, OR (US)

(72) Inventors: Arthur Parker Molinari, Portland, OR (US); Brent Radewald, Portland, OR (US); Todd Smith, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/746,196

(22) Filed: Jan. 17, 2020

(65) Prior Publication Data

US 2020/0230468 A1 Jul. 23, 2020

Related U.S. Application Data

(60) Provisional application No. 62/796,791, filed on Jan. 25, 2019, provisional application No. 62/794,217, filed on Jan. 18, 2019.

(51) Int. Cl.
*A63B 41/08* (2006.01)
*A63B 45/00* (2006.01)

(52) U.S. Cl.
CPC ..... *A63B 41/08* (2013.01); *A63B 45/00* (2013.01); *A63B 2209/00* (2013.01)

(58) Field of Classification Search
CPC ..... A63B 41/08; A63B 45/00; A63B 2209/00; A63B 2225/01
See application file for complete search history.

(56) References Cited

U.S. PATENT DOCUMENTS 1,931,429 A 10/1933 Buckner et al.
2,182,052 A 12/1939 Reach
(Continued)

FOREIGN PATENT DOCUMENTS

BE 1016122 A6 3/2006
EP 0885636 A1 12/1998
(Continued)

OTHER PUBLICATIONS

Merriam-Webster, "Concentric", <https://www.merriam-webster.com/dictionary/concentric>, retrieved on May 7, 2021. (Year: 2021).*
(Continued)

*Primary Examiner* — Steven B Wong
(74) *Attorney, Agent, or Firm* — Quinn IP Law

(57) ABSTRACT

A sports ball is provided and may include an interior bladder and a cover disposed about the interior bladder. The cover may comprise a plurality of adjoining panels. The cover may further define an exterior surface comprising a plurality of plateau sections and a plurality of indentations extending radially inward from the exterior surface. The plurality of indentations may include a plurality of peripheral channels or seams and a plurality of interior channels. Each seam has a seam length and the plurality of seams has a first aggregate deboss length. Each interior channel has a channel length and the plurality of interior channels has a second aggregate deboss length. Collectively, the seams and interior channels have an aggregate feature length, which is defined as a sum of the first aggregate deboss length and the second aggregate deboss length. The aggregate feature length is greater than 800 centimeters.

9 Claims, 8 Drawing Sheets

(56) References Cited

U.S. PATENT DOCUMENTS

| | | | | |
|---|---|---|---|---|
| 2,245,115 | A | 6/1941 | Reach | |
| 2,859,040 | A * | 11/1958 | Gow | A63B 41/08 473/596 |
| 3,512,777 | A | 5/1970 | Henderson | |
| 4,318,544 | A * | 3/1982 | Brine, Jr. | A63B 41/08 473/596 |
| 4,337,944 | A | 7/1982 | Massino | |
| 4,542,902 | A | 9/1985 | Massino | |
| 4,736,948 | A | 4/1988 | Thomas | |
| 4,928,962 | A | 5/1990 | Finley | |
| 4,991,842 | A | 2/1991 | Finley | |
| 5,354,053 | A * | 10/1994 | Ratner | A63B 41/08 473/596 |
| D357,958 | S | 5/1995 | Audero, Jr. | |
| 5,427,372 | A | 6/1995 | Ratner et al. | |
| 5,451,046 | A | 9/1995 | Batton | |
| 5,518,234 | A | 5/1996 | Palmquist | |
| 5,683,316 | A | 11/1997 | Campbell | |
| 5,735,761 | A | 4/1998 | Palmquist | |
| 5,851,161 | A | 12/1998 | Sassak | |
| D408,876 | S * | 4/1999 | Feeney | D21/713 |
| 5,931,752 | A | 8/1999 | Guenther et al. | |
| 5,984,812 | A | 11/1999 | Sassak | |
| 6,012,997 | A | 1/2000 | Mason | |
| 6,283,881 | B1 | 9/2001 | Feeney | |
| 6,302,815 | B1 | 10/2001 | Shishido et al. | |
| 6,406,389 | B1 | 6/2002 | Feeney et al. | |
| 6,422,961 | B1 | 7/2002 | Feeney | |
| 6,503,162 | B1 | 1/2003 | Shishido et al. | |
| 6,685,585 | B2 | 2/2004 | Shishido et al. | |
| 6,988,969 | B2 | 1/2006 | Avis | |
| 7,300,357 | B2 | 11/2007 | Breaker et al. | |
| 7,585,236 | B2 * | 9/2009 | Krysiak | A63B 41/08 473/597 |
| 7,614,959 | B1 | 11/2009 | Gentile | |
| 7,654,880 | B2 | 2/2010 | Schneider | |
| 7,854,671 | B2 | 12/2010 | Lalvani | |
| 8,002,652 | B2 | 8/2011 | Wong | |
| 8,182,379 | B2 | 5/2012 | Rapaport et al. | |
| 8,216,098 | B2 | 7/2012 | Lalvani | |
| 8,262,519 | B2 | 9/2012 | Raynak et al. | |
| 8,371,971 | B2 | 2/2013 | Bevier | |
| 8,529,386 | B2 | 9/2013 | Nuernberg et al. | |
| 8,579,743 | B2 | 11/2013 | Cohen et al. | |
| 8,597,144 | B2 | 12/2013 | Chang et al. | |
| 8,608,599 | B2 | 12/2013 | Raynak et al. | |
| 8,617,011 | B2 | 12/2013 | Berggren et al. | |
| 8,672,783 | B2 | 3/2014 | Fujikura et al. | |
| 8,684,870 | B2 | 4/2014 | Ito et al. | |
| 8,708,847 | B2 | 4/2014 | Berggren et al. | |
| 8,777,787 | B2 | 7/2014 | Raynak et al. | |
| 8,845,466 | B2 | 9/2014 | Bevier | |
| 8,852,039 | B2 | 10/2014 | White et al. | |
| 8,926,459 | B2 | 1/2015 | Berggren et al. | |
| 8,974,330 | B2 | 3/2015 | Berggren et al. | |
| 9,149,701 | B1 | 10/2015 | Bramlette | |
| 9,254,424 | B2 | 2/2016 | Berggren et al. | |
| 9,272,190 | B2 | 3/2016 | Tompkins | |
| 9,327,167 | B2 | 5/2016 | Raynak et al. | |
| 9,370,693 | B2 | 6/2016 | Berggren et al. | |
| 9,370,695 | B2 | 6/2016 | Chang et al. | |
| 9,452,322 | B2 | 9/2016 | Thurman et al. | |
| 9,457,239 | B2 | 10/2016 | White et al. | |
| 9,457,525 | B2 | 10/2016 | Berggren et al. | |
| 9,468,815 | B2 | 10/2016 | Berggren et al. | |
| 9,486,675 | B1 | 11/2016 | White | |
| 9,504,880 | B2 | 11/2016 | Bevier | |
| 9,539,473 | B2 | 1/2017 | Berggren et al. | |
| D786,374 | S | 5/2017 | Deaton et al. | |
| D786,375 | S | 5/2017 | Deaton et al. | |
| 9,694,247 | B2 | 7/2017 | Nurnberg | |
| 9,814,941 | B2 | 11/2017 | Cohen et al. | |
| 9,821,195 | B2 | 11/2017 | Raynak et al. | |
| 9,855,469 | B2 | 1/2018 | Berggren et al. | |
| 9,884,227 | B2 | 2/2018 | Berggren et al. | |
| 9,919,483 | B2 | 3/2018 | Nurnberg | |
| 10,016,935 | B2 | 7/2018 | Berggren et al. | |
| 10,343,026 | B2 * | 7/2019 | Berggren | A63B 41/08 |
| D863,473 | S | 10/2019 | Smith | |
| D863,474 | S | 10/2019 | Smith | |
| 2004/0142780 | A1 | 7/2004 | Estefano | |
| 2006/0105866 | A1 | 5/2006 | Ma | |
| 2006/0205544 | A1 | 9/2006 | Wyner et al. | |
| 2006/0229150 | A1 | 10/2006 | Ou | |
| 2007/0117662 | A1 | 5/2007 | Ma | |
| 2008/0032834 | A1 * | 2/2008 | Krysiak | A63B 41/08 473/597 |
| 2008/0287218 | A1 | 11/2008 | Freund | |
| 2009/0042659 | A1 | 2/2009 | Breaker et al. | |
| 2009/0325742 | A1 * | 12/2009 | Krysiak | A63B 41/08 473/596 |
| 2010/0255940 | A1 * | 10/2010 | Nuernberg | A63B 41/08 473/604 |
| 2011/0012309 | A1 | 1/2011 | Schreff | |
| 2011/0152018 | A1 | 6/2011 | Walling et al. | |
| 2011/0250819 | A1 | 10/2011 | Tashman | |
| 2011/0250997 | A1 | 10/2011 | Walling et al. | |
| 2012/0142465 | A1 * | 6/2012 | Berggren | A63B 45/00 473/604 |
| 2012/0172160 | A1 * | 7/2012 | Marc | B29C 65/24 473/604 |
| 2013/0005520 | A1 | 1/2013 | Chang et al. | |
| 2013/0059683 | A1 * | 3/2013 | Krysiak | A63B 41/02 473/597 |
| 2013/0260927 | A1 * | 10/2013 | Thurman | A63B 41/00 473/595 |
| 2014/0038741 | A1 | 2/2014 | Brooks | |
| 2014/0179468 | A1 | 6/2014 | Berggren et al. | |
| 2014/0179469 | A1 * | 6/2014 | Berggren | A63B 41/08 473/604 |
| 2015/0367183 | A1 | 12/2015 | Ou | |
| 2016/0082323 | A1 | 3/2016 | Higa et al. | |
| 2016/0089580 | A1 | 3/2016 | Nurnberg | |
| 2016/0243408 | A1 | 8/2016 | Tompkins | |
| 2016/0263444 | A1 * | 9/2016 | Nurnberg | A63B 45/00 |
| 2016/0287948 | A1 * | 10/2016 | Berggren | A63B 45/00 |
| 2016/0288438 | A1 | 10/2016 | Chang et al. | |
| 2016/0346627 | A1 | 12/2016 | Le et al. | |
| 2016/0346964 | A1 | 12/2016 | Nurnberg et al. | |
| 2017/0050089 | A1 | 2/2017 | Olivares Velasco | |
| 2017/0246512 | A1 | 8/2017 | Berggren et al. | |
| 2017/0291076 | A1 | 10/2017 | Campbell | |
| 2017/0354851 | A1 | 12/2017 | Lyon | |
| 2018/0078827 | A1 * | 3/2018 | Berggren | A63B 45/00 |
| 2018/0111024 | A1 | 4/2018 | Ou | |
| 2018/0133562 | A1 * | 5/2018 | Berggren | A63B 45/02 |
| 2018/0154220 | A1 | 6/2018 | Campbell | |
| 2018/0161636 | A1 | 6/2018 | Ahmed | |
| 2018/0169483 | A1 | 6/2018 | Ou | |
| 2018/0200969 | A1 | 7/2018 | Nurnberg | |
| 2018/0243614 | A1 * | 8/2018 | Berggren | A63B 45/00 |
| 2018/0243615 | A1 | 8/2018 | Berggren et al. | |
| 2018/0339202 | A1 * | 11/2018 | Molinari | A63B 43/06 |
| 2019/0184242 | A1 | 6/2019 | Molinari | |
| 2020/0070011 | A1 * | 3/2020 | Molinari | A63B 41/08 |
| 2020/0070012 | A1 * | 3/2020 | Molinari | A63B 45/02 |
| 2020/0171359 | A1 * | 6/2020 | Molinari | A63B 41/02 |
| 2020/0230468 | A1 * | 7/2020 | Molinari | A63B 41/08 |

FOREIGN PATENT DOCUMENTS

| | | | |
|---|---|---|---|
| GB | 2375054 | A | 11/2002 |
| GB | 2447845 | A | 10/2008 |
| WO | 2005115561 | A1 | 12/2005 |
| WO | 2018217443 | A1 | 11/2018 |

OTHER PUBLICATIONS

Adrian L. Kiratidis and Derek B. Leinweber, An Aerodynamic Analysis of Recent FIFA World Cup Balls, Special Research Centre for the Subatomic Structure of Matter, Department of Physics, The University of Adelaide, SA, 5005, Australia, Feb. 20, 2018.

(56) References Cited

OTHER PUBLICATIONS

F. Alam, H. Chowdhury, B. Loganathan, I. Mustary and S. Watkins, Aerodynamic Drag of Contemporary Soccer Balls, 19th Australasian Fluid Mechanics Conference, Melbourne, Australia, Dec. 2014.

Firoz Alam, Harun Chowdhury, Mark Stemmer, Zilong Wang and Jie Yang, Effects of surface structure on soccer ball aerodynamics, Procedia Engineering 34 (2012) pp. 146-151, Published by Elsevier Ltd.

John Eric Goff, Matt J. Carre, Investigations into soccer aerodynamics via trajectory analysis and dust experiments, Procedia Engineering 34 (2012) pp. 158-163, Published by Elsevier Ltd.

John Eric Goff, Sungchan Hong and Takeshi Asai, Aerodynamic and surface comparisons between Telstar 18 and Brazuca, Journal of Sports Engineering and Technology, 2018, pp. 1-7, DOI: 10.1177/1754337118773214.

Luca Oggiano, Lars Saetran, Aerodynamics of modern soccer balls, Procedia Engineering 2 (2010) pp. 2473-2479, Published by Elsevier Ltd.

Pouya Jalilian, Patrick K. Kreun, Mohammadhady M. Makhmalbaf and William W. Liou, Computational Aerodynamics of Baseball, Soccer Ball and Volleyball, American Journal of Sports Science, vol. 2, No. 5, 2014, pp. 115-121, doi: 10.11648/j.ajss.20140205.12.

Sungchan Hong and Takeshi Asai, Aerodynamic effects of dimples on soccer ball surfaces, Heliyon 3 (2017) e00432, doi: 10.1016/j.heliyon.2017.e00432.

Sungchan Hong and Takeshi Asai, Effect of panel shape of soccer ball on its flight characteristics, Sci. Rep. 4, 5068; DOI:10.1038/srep05068 (2014).

T. Asai, K. Seo, O. Kobayashi and R. Sakashita, Fundamental aerodynamics of the soccer ball, Sports Engineering (2007) 10, pp. 101-110.

Takeshi Asai, Kazuya Seo, Aerodynamic drag of modern soccer balls, SpringerPlus 2013, 2:171, Published Apr. 19, 2013.

* cited by examiner

SPORTS BALL

CROSS-REFERENCE TO RELATED APPLICATIONS

This application claims the benefit of U.S. Provisional Application No. 62/794,217, filed Jan. 18, 2019 and U.S. Provisional Application No. 62/796,791, filed Jan. 25, 2019, which are hereby incorporated by reference in their entirety.

TECHNICAL FIELD

The disclosure relates to inflatable sports balls.

BACKGROUND

A variety of inflatable sport balls, such as a soccer ball, conventionally exhibit a layered structure that includes a casing, an intermediate structure, and a bladder. The casing forms an exterior portion of the sports ball and is generally formed from a plurality of durable and wear-resistant panels joined together along abutting edge areas (e.g., with stitching, adhesives, or bonding), i.e., via a seam. Designs such as decorative elements and holistic textural patterns may be applied to the exterior surface of the casing. Decorative elements are conventionally applied via processes such as thermal transfer films or a release paper. Textural patterns are conventionally applied via processes such as embossing, debossing, stamping, molding, or laser etching.

The intermediate structure forms a middle portion of the sport ball and is positioned between the casing and the interior. Among other purposes, the intermediate structure may provide a softened feel to the sports ball, impart energy return, and restrict expansion of the bladder. In some configurations, the intermediate structure or portions of the intermediate structure may be bonded, joined, or otherwise incorporated into the casing as a backing material. In other configurations, the intermediate structure or portions of the intermediate structure may be bonded, joined, or otherwise incorporated into the interior.

SUMMARY

A sports ball is provided. The sports ball may include an interior bladder and a cover disposed about the interior bladder. The cover may comprise a plurality of adjoining panels. The cover may further define an exterior surface comprising a plurality of plateau sections and a plurality of indentations extending radially inward from the exterior surface.

Each of the plurality of indentations has an indentation length and collectively the plurality of indentations has an aggregate feature length, which is defined as a sum of all of the indentation lengths. The aggregate feature length is greater than 800 centimeters.

DETAILED DESCRIPTION

Figure 1:
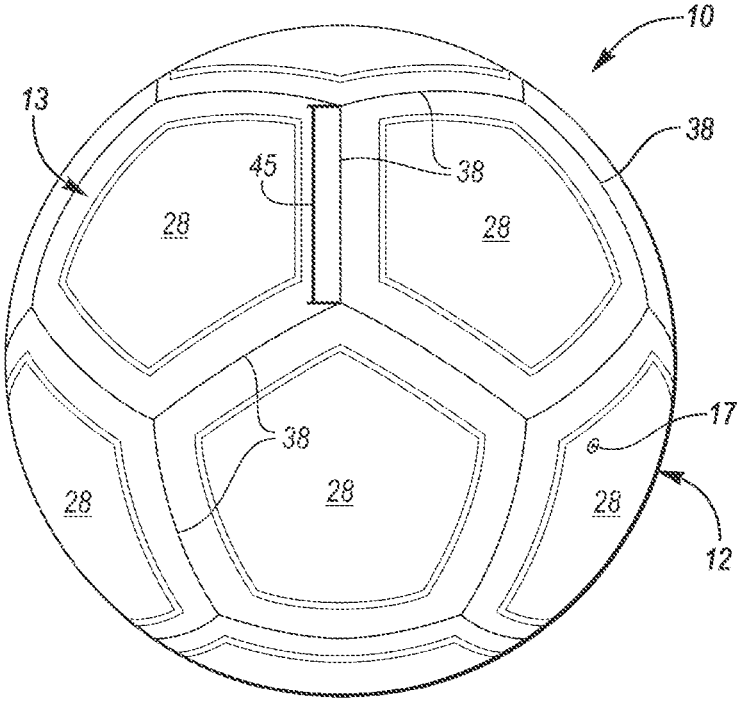
FIG. 1 is a schematic perspective view of an example inflatable sports ball.

While the present disclosure may be described with respect to specific applications or industries, those skilled in the art will recognize the broader applicability of the disclosure. Those having ordinary skill in the art will recognize that terms such as "above," "below," "upward," "downward," etc., are used descriptively of the figures, and do not represent limitations on the scope of the disclosure, as defined by the appended claims. Any numerical designations, such as "first" or "second" are illustrative only and are not intended to limit the scope of the disclosure in any way.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The terms "a," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The following discussion and accompanying figures disclose various sports ball configurations and methods relating to manufacturing of the sport balls. Although the sports ball is depicted as a soccer ball in the associated Figures, concepts associated with the configurations and methods may be applied to various types of inflatable sport balls, such as basketballs, footballs (for either American football or rugby), volleyballs, water polo balls, etc. and variety of non-inflatable sports balls, such as baseballs and softballs, may also incorporate concepts discussed herein.

Referring to the drawings, wherein like reference numerals refer to like components throughout the several views, a sports ball 10 is provided. In a general sense, the sports ball 10 of the present disclosure includes a plurality of outer panels 28 that each have a predefined panel arrangement 75, 76 defined thereon by a plurality of plateau sections 35 and a plurality of indentations 34, 38. Each of the plurality of indentations 34, 38 has a terminus 63, 65 that is radially spaced apart from the exterior surface 13 by an indentation depth 41, 67. Further, each indentation has an indentation length 45, 50 and the plurality of indentations 34, 38 has an aggregate feature length, wherein the aggregate feature length is defined as a sum of all of the indentation lengths 45, 50. The aggregate feature length is greater than 800 centimeters.

Sports balls 10 having increased aggregate feature lengths, particularly those having aggregate feature lengths greater than 800 centimeters have been found to exhibit aerodynamic consistency and softness and feel characteristics that are improved from conventional designs. Based on qualitative assessment based on visual observations, increased aggregate feature length and increased surface coverage of the exterior surface 13 by the indentations 34, 38 creates positive flight characteristics (consistency and length of trajectory) and enhances the aerodynamics of ball 10, i.e., reducing aerodynamic drag on the ball for better accuracy, consistency, and increased velocity.

When an example sports ball 10 maintains an aggregate feature length of greater than 800 centimeters and has 40%-70% of the exterior surface 13 occupied by the indentations 34, 38, it is more likely that the boundary layer of air surrounding the sports ball 10 in flight will undergo the transition from laminar flow to turbulent flow at a predetermined point. This forced alteration of the flow of air around the ball 10, e.g., tripping the boundary layer from laminar flow to turbulent flow at a predetermined point on the ball 10, increases lift on the ball 10 and promotes stability and consistency of the ball 10 in flight, which thereby reduces the likelihood of, for example, unwanted dip of the ball 10 during a driven shot on goal by a player toward the end of the driven shot and/or wobble during flight.

Figure 2:
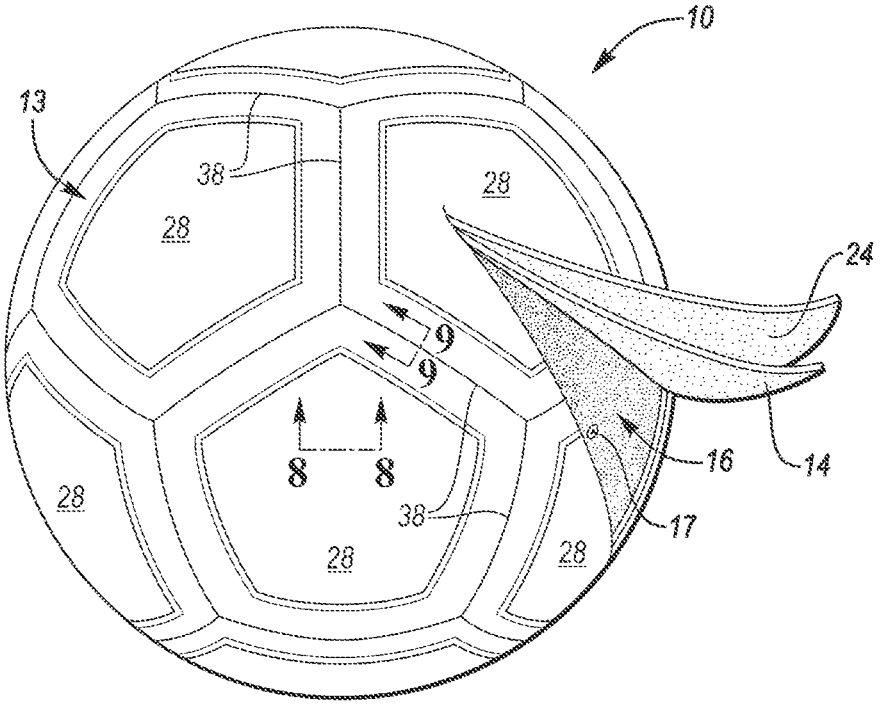
FIG. 2 is a schematic perspective view of an example inflatable sports ball, wherein the ball includes an interior bladder and a cover, the cover including an outer substrate layer and an intermediate structure.
Figure 8:
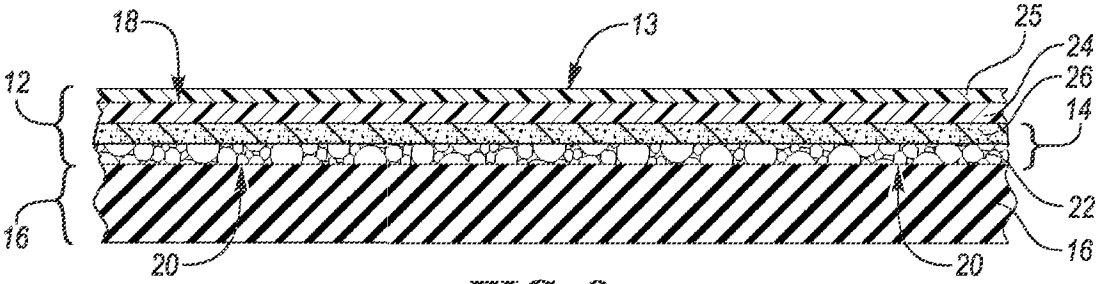
FIG. 8 is an enlarged, schematic, example cross-sectional view of the cover shown in FIG. 2, taken along line 8-8.

As shown in FIGS. 1-3 and 5, the sports ball 10 may be an inflatable sports ball such as a soccer ball or the like or a non-inflatable sports ball 10 such as a softball or the like. A sports ball 10 having the general configuration of a soccer ball is depicted in FIGS. 1-3 and 5. As shown in FIGS. 1 and 2, the sports ball 10 may have a layered structure including a cover 12 and an interior 16 (FIGS. 2 and 8). The cover 12 forms an exterior portion of the sports ball 10. The interior 16 forms an interior portion of sports ball 10.

In a non-inflatable example configuration of the sports ball 10, the interior 16 may be one of a solid mass and hollow mass, fixed in size. In an inflatable example configuration of the sports ball 10, the interior 16 may be an interior bladder (FIGS. 2 and 8). In the inflatable example configuration, in order to facilitate inflation (i.e., fill the interior with pressurized air), the interior 16 generally includes a valved opening 17 that extends through the cover 12, thereby being accessible from an exterior surface 13 of the sports ball 10. Upon inflation, the bladder 16 is pressurized and the pressurization induces the exterior surface 13 of the cover 12 to be a substantially spherical surface as the sports ball 10 takes on a substantially spherical shape. More particularly, pressure within bladder 16 causes the bladder 16 to place an outward force upon the cover 12 on an inner substrate surface 20.

The cover 12 forms an exterior portion of the sports ball 10 and defines the exterior surface 13. The term cover 12 is meant to include any layer of the sports ball 10 that surrounds the interior 16. Thus, the cover 12 has a thickness 88 and may include both the outermost layer 24, 25 and also any intermediate layers 22, 26, which are disposed between the interior 16 and the exterior surface 13. As shown in FIGS. 2 and 7-9, the cover 12 may be composed as a layered structure including an outer substrate layer 24 and an intermediate structure 14 located interior to the outer substrate layer 24 between the outer substrate layer 24 and the interior 16. The outer substrate layer 24 further defines an outer substrate surface 18. The inner substrate surface 20 is disposed opposite the outer substrate surface 18, and may be disposed adjacent to the ball interior 16.

In some embodiments, the outer substrate layer 24 may be a composed of a polymeric material, a polymer foam material, or the like. Examples of suitable polymer materials include, but are not limited to, polyurethane, polyvinylchloride, polyamide, polyester, polypropylene, polyolefin, and the like.

The intermediate structure 14 may include a first intermediate cover layer 26 and a second intermediate cover layer 22. The first intermediate cover layer 26 is positioned between the outer substrate layer 24 and the second intermediate cover layer 22. The second intermediate cover layer 22 is positioned between the first intermediate cover layer 26 and the interior bladder 16. The second intermediate cover layer 22 may include the inner substrate surface 20, wherein the inner substrate surface 20 is positioned adjacent to the ball interior 16.

The respective cover layers 22, 26 of the intermediate structure 14 may be composed of a polymeric material, a polymer foam material, a foam material, textiles, or the like. Examples of suitable polymer materials include, but are not limited to, polyurethane, polyvinylchloride, polyamide, polyester, polypropylene, polyolefin, and the like. Examples of suitable polymer foam materials include, but are not limited to, polyurethane, ethylvinylacetate, and the like. Examples of suitable textile materials include, but are not limited to, a woven or knit textile formed from polyester, cotton, nylon, rayon, silk, spandex, or a variety of other materials. A textile material may also include multiple materials, such as a polyester and cotton blend. The intermediate structure 14 may further provide a softened feel to the sports ball 10, impart energy return, and restrict expansion of bladder 16, in an inflatable sports ball 10 example. In one example, the outer substrate layer 24 may be formed from a thermoplastic polyurethane material (TPU), first intermediate layer 26 may be formed from a polymer foam material, the second intermediate layer 22 may be formed from one or more of a polymeric material, a polymer foam material, a foam material, or a textile material.

As shown in FIG. 8, the cover 12 may further include an external surface layer 25 disposed upon the outer substrate surface 18 of the cover 12. The external surface layer 25 may be a film that includes a pigment or a graphic thereon. The external surface layer 25 may also be an outer film or clear coat having weather resistant properties. The external surface layer 25 may be a polyurethane film or the like. The external surface layer 25 may be bonded to the outer substrate surface 18 via a suitable bonding material or adhesive.

As shown in FIGS. 1-6, the cover 12 may be generally formed by a plurality of adjoining panels 28. Each panel 28 may have a respective panel surface that defines a portion of the outer substrate surface 18. The plurality of adjoining panels 28 includes at least a first panel 30 having a first panel surface and a second panel 40 having a second panel surface. The plurality of adjoining panels 28 may comprise the conventional twelve (12) panels or any other number of panels 28. For example, four joined panels 28 each having nine edges 36 and having a generally triangular shape that is formed from three pentagons. The cover 12 may also exhibit a substantially uniform or unbroken configuration that does not include panels 28 joined at abutting edge areas 36 via seams, or may include fewer panels 28. Each panel 28 may have a panel center 37 and a panel limit 39, wherein the panel limit 39 runs adjacent to the respective abutting edge area 36.

As shown in FIGS. 3-7, and 9-10G, the cover 12 may further define a plurality of indentations 34, 38. Each of the indentations of the plurality of indentations 34, 38 may extend radially inward from the exterior surface 13. The exterior surface 13 of the cover 12 may further define a plurality of plateau sections 35 disposed between the indentations 34, 38. The plurality of indentations 34, 38 may be further defined as a plurality of peripheral seams 38 and plurality of interior channels 34.

In one example, the plurality of peripheral seams 38 may be defined as a plurality of seams 38 configured to couple the plurality of adjoining panels 28, such that each of the peripheral seams 38 being positioned between one of the plurality of adjoining panels 28 and another of the plurality of adjoining panels 28. The respective panels 28 may be coupled together along abutting edge areas 36 (FIGS. 4, 6, and 8) via at least one seam 38 (FIGS. 1-6 and 9).

The panels 28 may be coupled along the abutting edge areas 36 by the seam 38 with stitching, bonding, welding, adhesives, or another suitable coupling method. As utilized herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof (e.g., "thermal bond") is defined as the bond, link, or structure that joins two elements through a process that involves a softening or melting of a polymer material within at least one of the elements such that the materials of the elements are secured to each other when cooled.

An example of welded seams 38 is disclosed in U.S. Pat. No. 8,608,599 to Raynak, et al., which is hereby entirely incorporated herein by reference. U.S. Pat. No. 8,608,599 to Raynak, et al. generally discloses examples of welded seams, in that welding generally produces a heat-affected zone in which the materials of the two joined components are intermingled. This heat-affected zone may be considered a "weld" or "thermal bond." Further, welding may involve (a) the melting or softening of two panels that include polymer materials such that the polymer materials from each panel intermingle with each other (e.g., diffuse across a boundary layer between the polymer materials) and are secured together when cooled, as well as (b) the melting or softening a polymer material in a first panel such that the polymer material extends into or infiltrates the structure of a second panel (e.g., infiltrates crevices or cavities formed in the second panel or extends around or bonds with filaments or fibers in the second panel) to secure the panels together when cooled. Further, welding may occur when only one panel includes a polymer material or when both panels include polymer materials.

Figure 9:
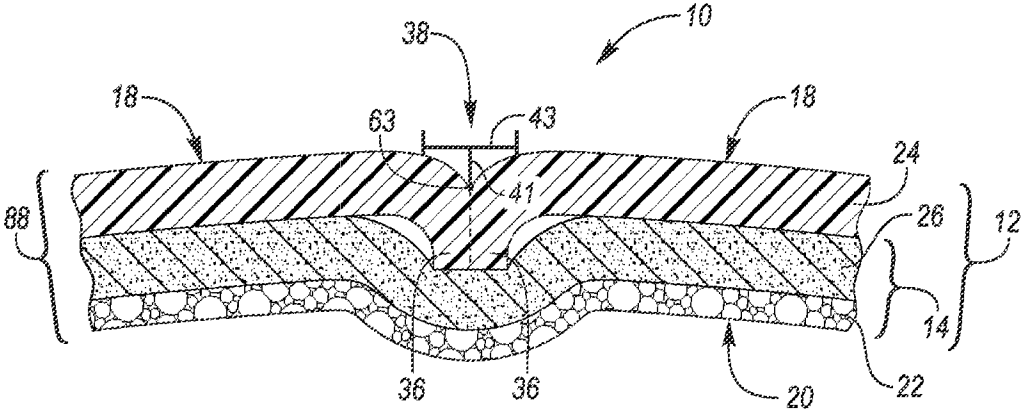
FIG. 9 is an enlarged, schematic, example cross-section of an indentation, wherein the indentation is defined as a peripheral seam, as shown in FIG. 2, taken along line 9-9.

Referring to FIG. 9, each peripheral seam 38 has a seam terminus 63 that is radially-spaced apart from and radially extending inward from the exterior surface 13 toward the inner substrate surface 20. Further, each seam 38 has a seam depth 41 and a seam width 43. The seam terminus 63 is radially-spaced apart from the outer substrate surface 18 the seam depth 41. Accordingly, each peripheral seam 38 may have a seam aspect ratio. The seam aspect ratio being defined as the ratio of the seam width 43 to the seam depth 41. In one example, as shown in FIGS. 3-6, the seam depth 41 may be greater than 0.4 millimeters. More particularly, the seam depth 41 may be from about 0.45 millimeters to about 0.60 millimeters. The seam width 43 may be from about 0.55 centimeters to 0.60 centimeters.

Further, each seam 38 may have a seam length 45 (FIG. 1). The plurality of peripheral seams 38 may further define a first aggregate deboss length. The first aggregate deboss length is defined as a sum of all of the seam lengths 45. In some example embodiments, the first aggregate deboss length may be from about 135 centimeters to about 150 centimeters. As shown in the examples in FIGS. 3-6, the first aggregate deboss length may be about from about 138 centimeters to about 142 centimeters. More particularly, the first aggregate deboss length may be from about 140 centimeters to about 141 centimeters.

Referring to FIGS. 3-7 and 10A-10G, the plurality of interior channels 34 may be formed as a plurality of debossed features. The term debossed feature as used herein is defined as an indentation in the cover 12 that is not a seam 38. Debossed features may impart various advantages to the ball 10. For example, debossed features may enhance the aerodynamics of ball 10 or provide a greater amount of consistency or control over ball 10 during play, e.g., during kicking, dribbling, or passing.

In some example embodiments, interior channels 34 may be spaced apart from the peripheral seams 38 of the sport ball 10. In an example embodiment, wherein the cover 12 has a substantially uniform or unbroken configuration that does not include panels 28 or includes fewer panels, an interior channel 34 may be positioned in areas of the cover 12 that correspond with the positions of seams 38 in a conventional sports ball 10, in order to impart the appearance of seams 38.

The plurality of interior channels 34 may be formed on the cover 12 via a variety of manufacturing processes including, but not limited to, debossing. Examples of a manufacturing process for forming debossed features are disclosed in U.S. Pat. No. 9,370,693 to Berggren, et al., which is hereby entirely incorporated by reference herein. U.S. Pat. No. 9,370,693 to Berggren, et al. generally discloses a variety of manufacturing processes that may be utilized to form debossed features in panels. In one example, one of panels is located on a platen. A press plate is positioned above platen and includes a protrusion having a predetermined shape. The protrusion presses into and heats the areas of panel forming the debossed features. The press plate then moves away from panel to substantially complete the formation of the debossed feature.

As shown in FIGS. 3-7, and 10A-10G, each interior channel 34 has a channel terminus 65 that is radially-spaced apart from and extends radially inward from the exterior surface 13 toward the inner substrate surface 20. Further, each interior channel 34 has a channel depth 67 and a channel width 61. The channel terminus 65 is radially-spaced apart from the exterior surface 13 by the channel depth 67. Each channel 34 further comprises a first boundary 87 and a second boundary 89, such that the channel width 61 is disposed between the first boundary 87 and the second boundary 89. Each of the first boundary 87 and the second boundary 89 of the respective channel 34 border respective plateau sections 35.

Referring to FIGS. 10A-10G, the interior channels 34 are formed in the cover 12 and extend radially inward from the exterior surface 13 toward the interior 16. The intermediate structure 14 is positioned between the outer substrate layer 24 and the interior bladder 16. The outer substrate layer 24 may be bonded to the intermediate structure 14 at the respective interior channel 34. More particularly, the outer substrate layer 24 may be welded directly to the second intermediate cover layer 22 at the channel terminus 65 of the respective interior channel 34 (FIGS. 10A-C and 10E-G), such that the outer substrate layer 24 extends through an entirety of the channel depth 67 at each of the interior channels 34.

The interior channels 34 may include a first portion 82 and a second portion 84. The first portion 82 has the terminus 65 thereon that is radially-spaced apart from the exterior surface 13 by the channel depth 67.

Figure 10A:
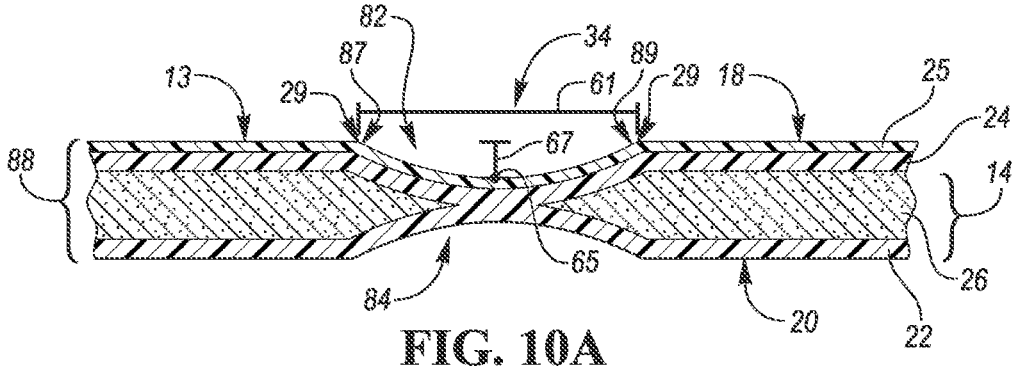
FIG. 10A is an enlarged, schematic, example cross sectional view of an indentation, wherein the indentation is defined as an interior channel.
Figure 10B:
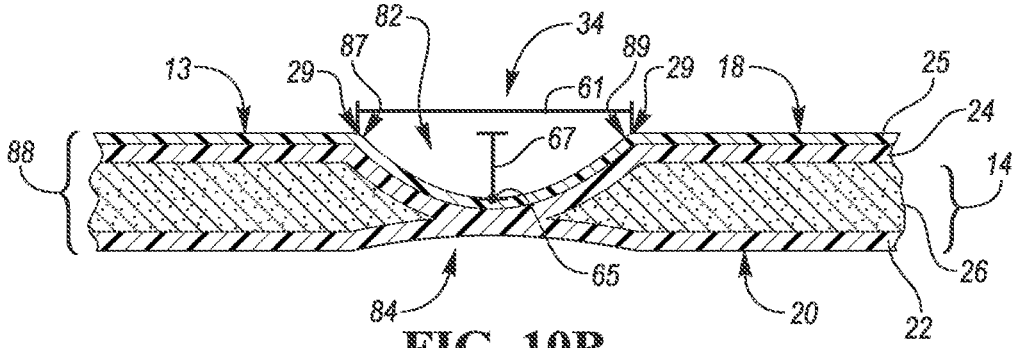
FIG. 10B is an enlarged, schematic, example cross sectional view of an indentation, wherein the indentation is defined as an interior channel.
Figure 10C:
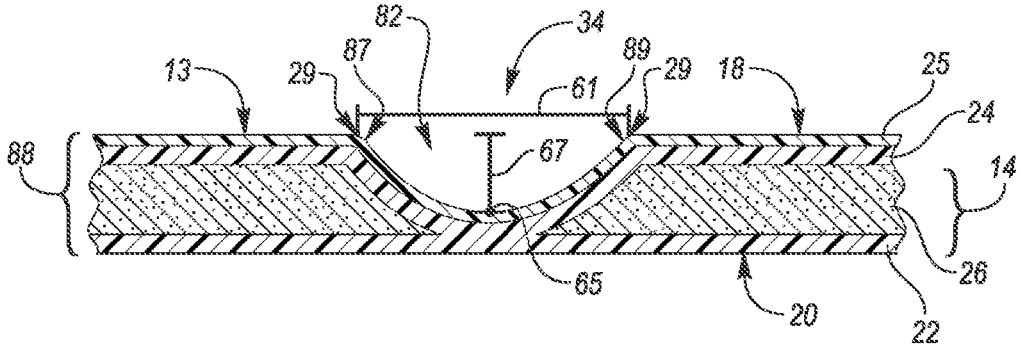
FIG. 10C is an enlarged, schematic, example cross sectional view of an indentation, wherein the indentation is defined as an interior channel.

The specific configuration of the interior channels 34 may vary considerably. Referring to FIG. 10A-10D, the first portion 82 and the second portion 84 may have a generally rounded configuration. As depicted in FIG. 10A the first and second portions 82 and 84 extend to an approximate midpoint of the thickness 88 of the panel cross-section. In another configuration, as depicted in FIGS. 10B and 10C, the first portion 82 extends through more of the thickness 88 of panel cross section than the second portion 84. In yet another configuration, as depicted in FIG. 10C, the first portion 82 extends through substantially all of the thickness 88 of panel cross-section. As also shown in FIG. 10C, in some embodiments, the second intermediate layer 22 may have a substantially planar configuration opposite the first portion 82. Said another way, in some embodiments, the interior channel 34 may have only a first portion 82 and no second portion 84.

Figure 10D:
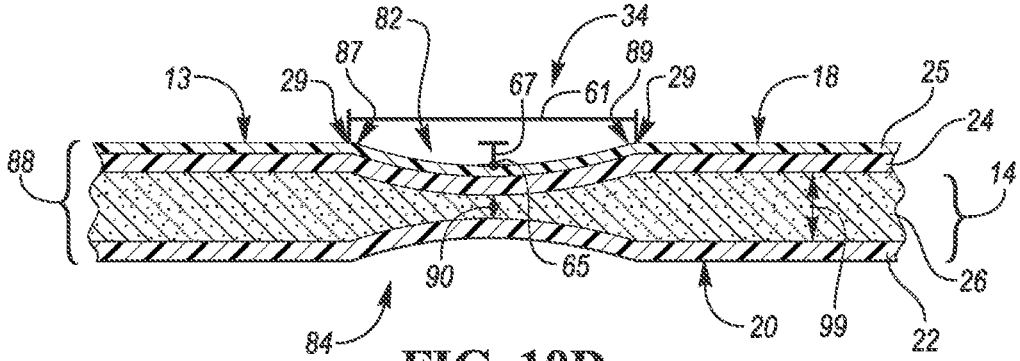
FIG. 10D is an enlarged, schematic, example cross sectional view of an indentation, wherein the indentation is defined as an interior channel.

Referring to FIG. 10D, the first and second portions 82 and 84, as well as the outer substrate layer 24 and the second intermediate cover layer 22, may be spaced from each other, such that a portion of the first intermediate layer 26 extends between portions 82, 84 and between the outer substrate layer 24 and the second intermediate cover layer 22. In this configuration, the outer substrate layer 24 is bonded to the first intermediate layer 26 at the respective interior channel 34. In such an example, the first intermediate layer 26 has a first thickness 90 between portions 82, 84 and at the terminus 65 of the first portion 82. In the same example, the first intermediate layer 26 has a second thickness 99 between the outer substrate layer 24 and the second intermediate cover layer 22 in an area spaced apart from portions 82, 84 and the terminus 65 of the first portion 82. As shown in FIG. 10D, the first thickness 90 is less than the second thickness 99.

Figure 10E:
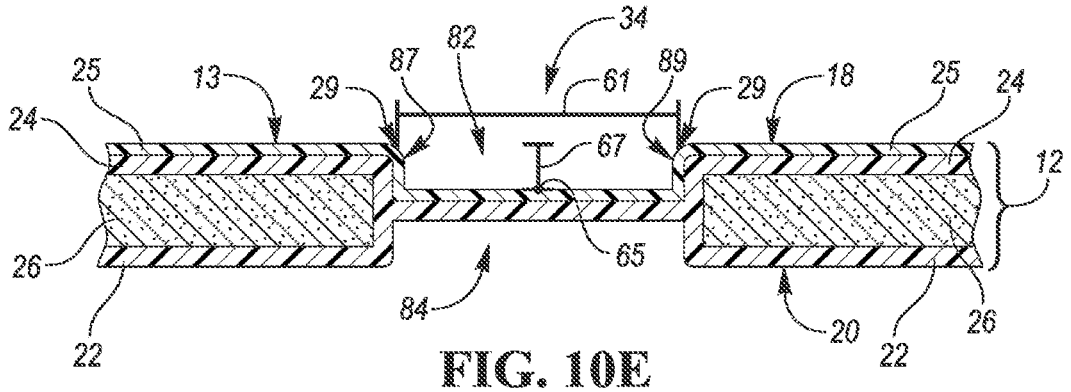
FIG. 10E is an enlarged, schematic, example cross sectional view of an indentation, wherein the indentation is defined as an interior channel.
Figure 10F:
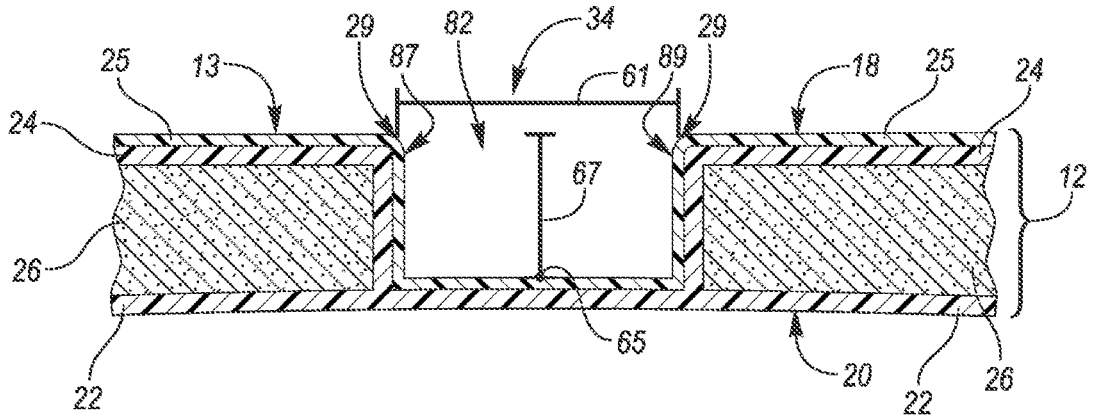
FIG. 10F is an enlarged, schematic, example cross sectional view of an indentation, wherein the indentation is defined as an interior channel.
Figure 10G:
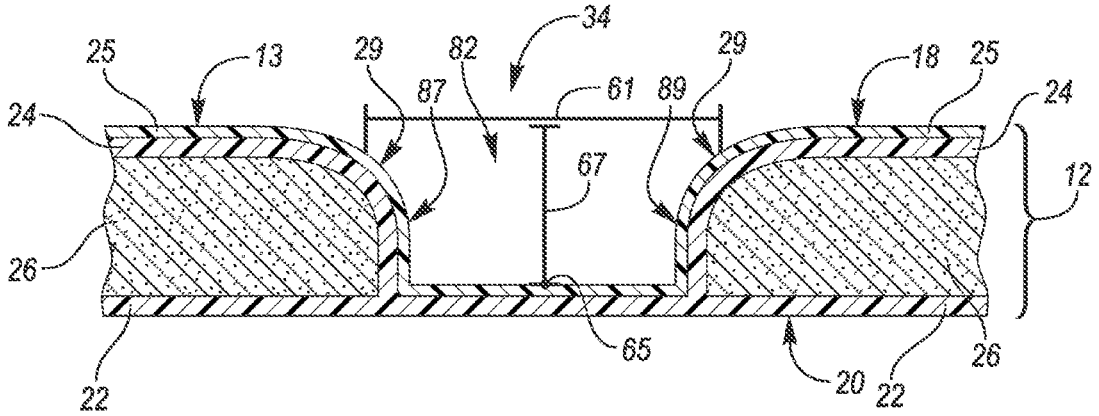
FIG. 10G is an enlarged, schematic, example cross sectional view of an indentation, wherein the indentation is defined as an interior channel.

Alternatively, the interior channels 34 may include a first portion 82 and a second portion 84 that exhibit substantially squared configurations (FIGS. 10E-10G). For example, in some embodiments, the portions 82, 84 may have substantially squared cross-sectional configurations. Interior channels 34 with substantially squared cross-sectional configurations may have a more distinct appearance than portions 82, 84 having substantially rounded cross-sectional configurations. In addition, interior channels 34 with substantially squared portions 82, 84 may also provide performance benefits such as aerodynamics, ball feel, and water channeling.

As shown in FIG. 10E, the first portion 82 and second portion 84 are two opposing indentations having substantially squared cross-sectional configurations. In FIG. 10E, the indentations 82, 84 extend to an approximate midpoint of the thickness 88 of the panel cross-section, such that the channel terminus 65 of the first portion 82 is positioned radially inward from the exterior surface 13 to the approximate midpoint of the thickness 88 of the panel cross-section.

In FIGS. 10F-10G, the first portion 82 may extend through substantially the entirety of the thickness 88 of the panel cross section. As also shown in FIG. 10F-10G, in some embodiments, second intermediate layer 22 may have a substantially planar configuration opposite the first portion 82. Said another way, in some embodiments, the debossed feature 34 may have only a first portion 82 and no second portion 84.

As shown in FIGS. 10F-10G, in one example embodiment, the interior channel 34 may include substantially-squared first portion 82 having a rounded shoulder portion 29. In some embodiments, a substantially-squared shoulder portion 29 may have a minimal radius, as shown in FIG. 10F. In another example embodiment, a rounded shoulder portion 29 having a larger radius may be used, as shown in FIG. 10G.

Figure 3A:
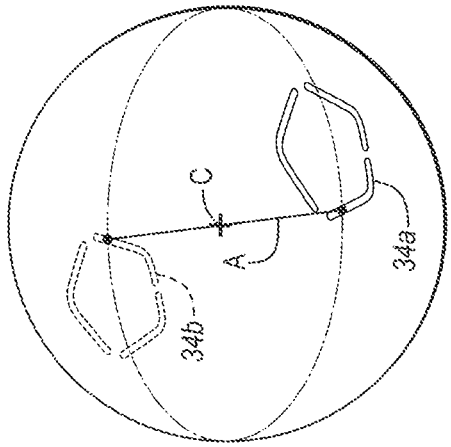
FIG. 3A is a schematic perspective view of the first example sports ball of FIG. 3, wherein the sports ball has a ball center and a central axis.
Figure 3:
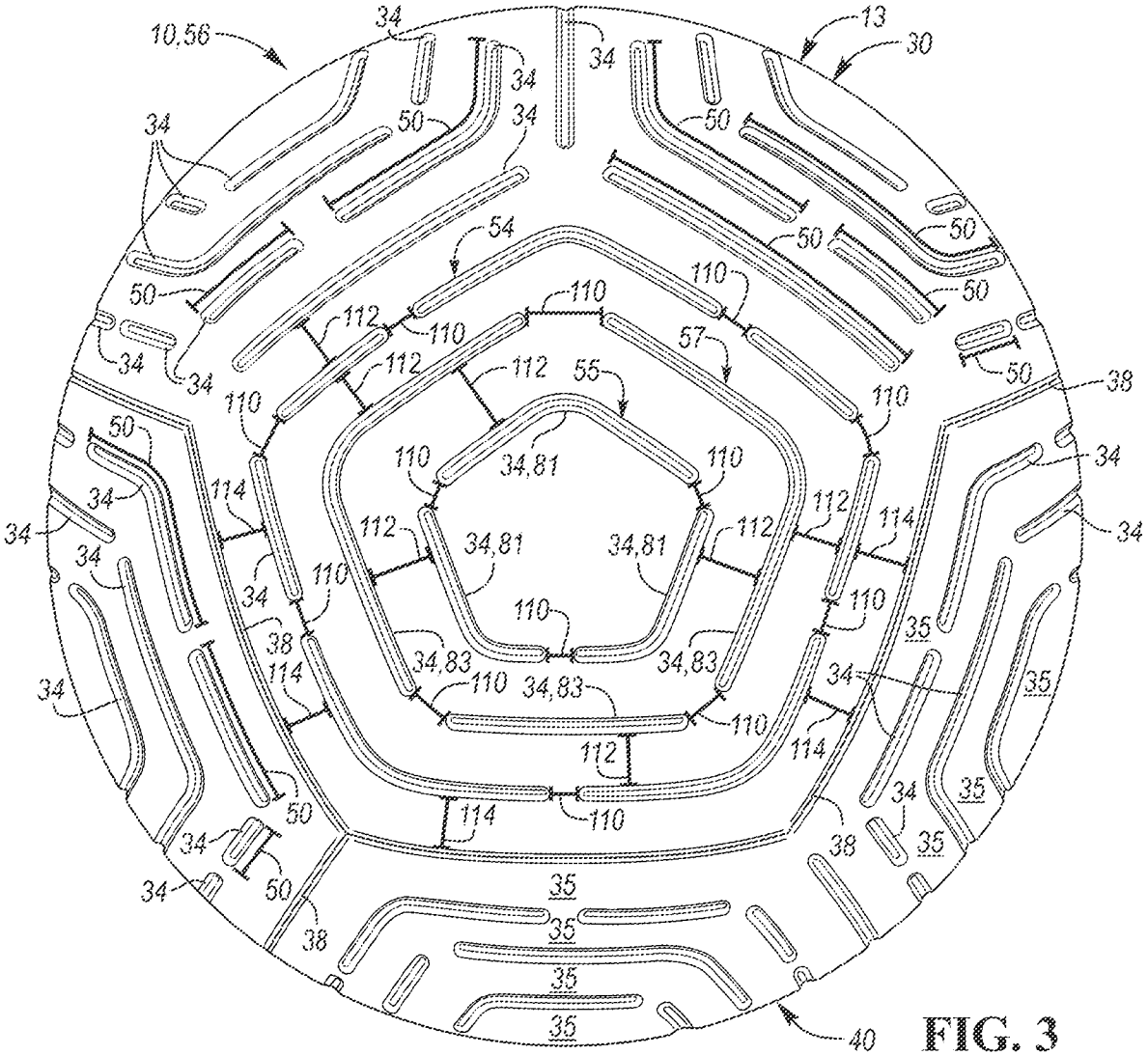
FIG. 3 is a schematic perspective view of a first example inflatable sports ball, wherein the cover defines a plurality of peripheral channels, a plurality of interior channels, and a plurality of plateaus sections, which cooperate to define a topographical design on the exterior surface of the inflatable sports ball.
Figure 4:
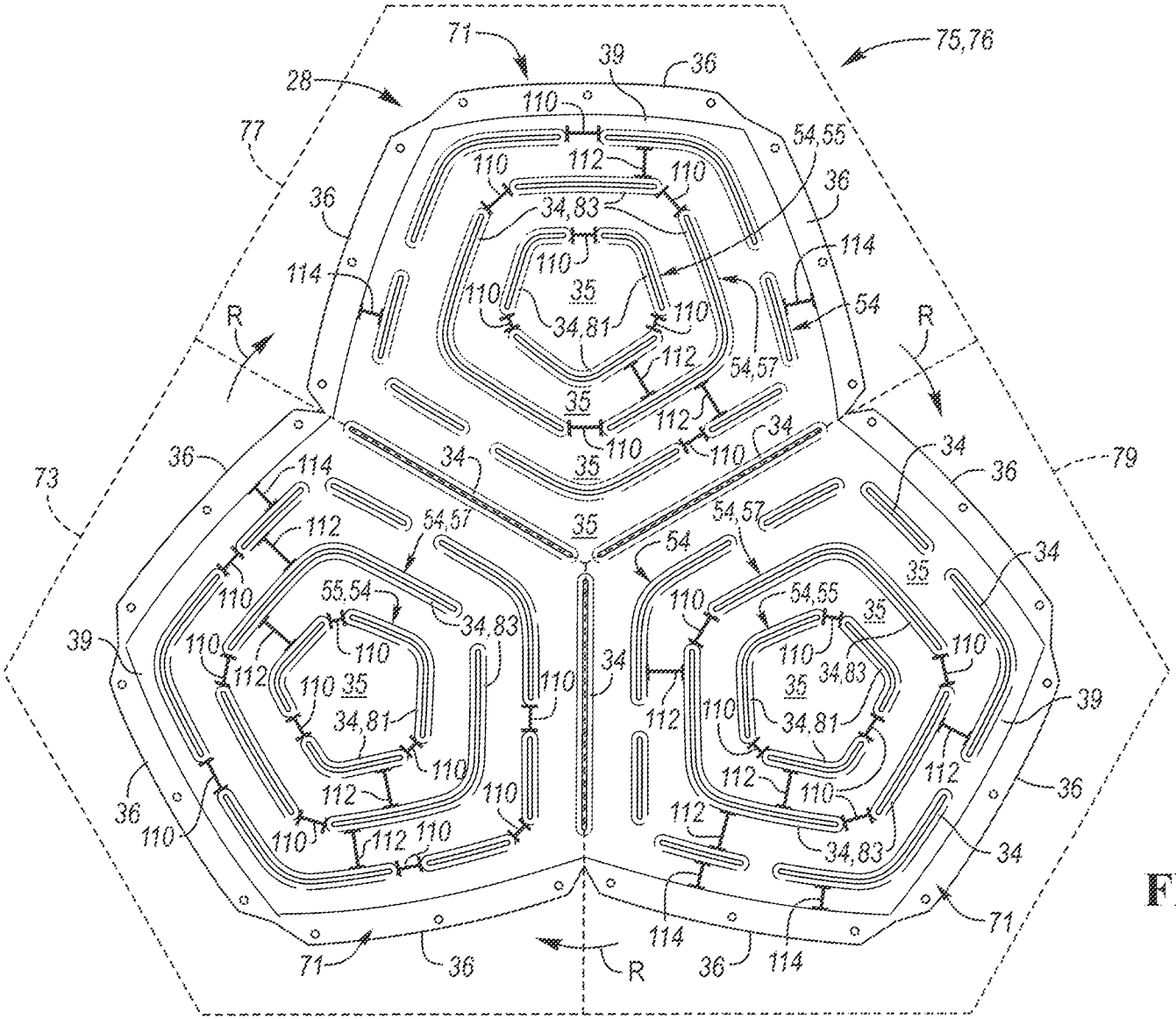
FIG. 4 is a schematic plan view of an example panel of the first example sports ball, wherein the example panel has a generally triangular shape that is formed from three pentagons.
Figure 5:
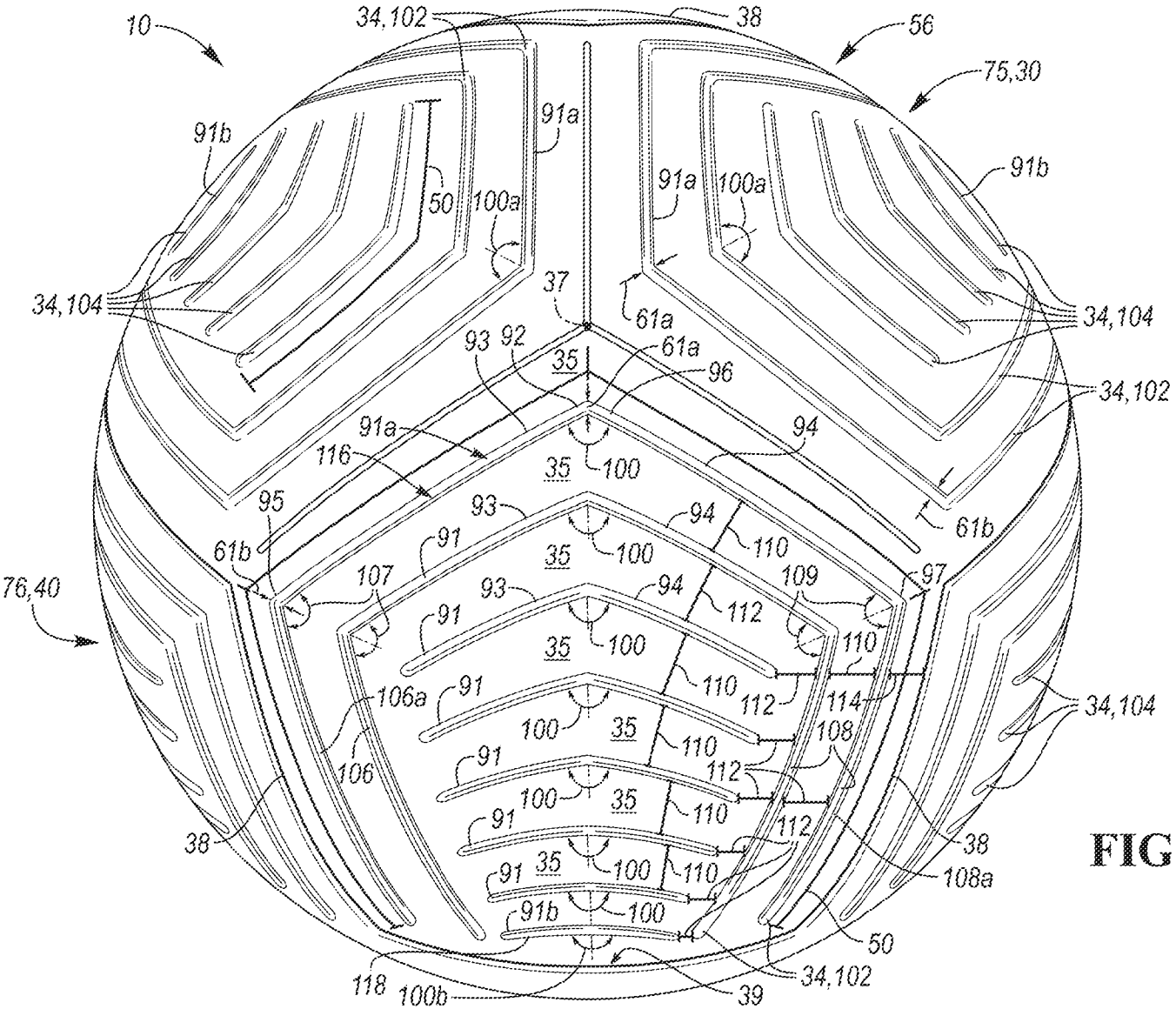
FIG. 5 is a schematic perspective view of a second example inflatable sports ball, wherein the cover defines a plurality of peripheral channels, a plurality of interior channels, and a plurality of plateaus sections, which cooperate to define a topographical design on the exterior surface of the inflatable sports ball.
Figure 6:
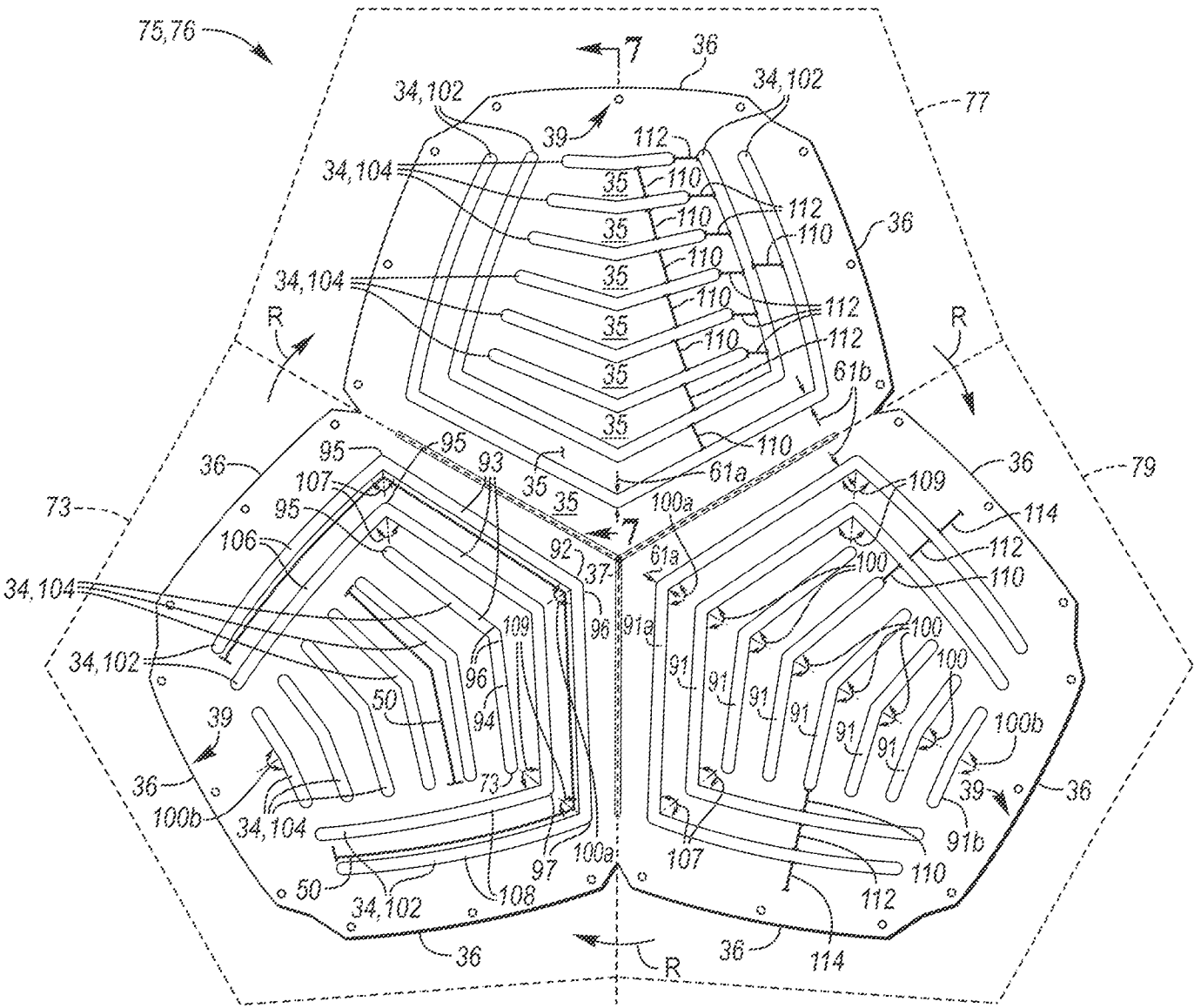
FIG. 6 is a schematic plan view of an example panel of the second example sports ball, wherein the example panel has a generally triangular shape that is formed from three pentagons.
Figure 7:
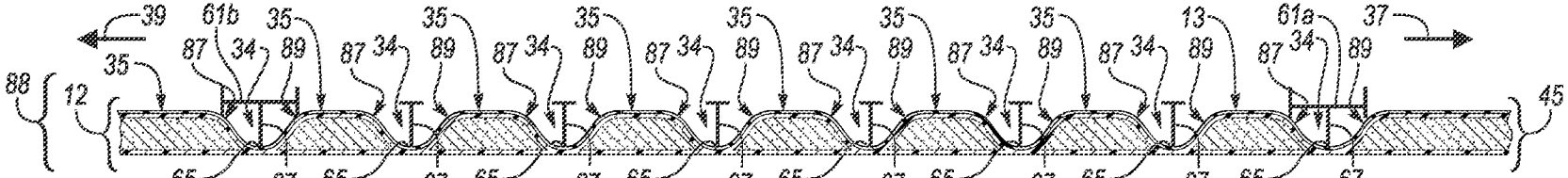
FIG. 7 is an enlarged, schematic, example cross-sectional view of the panel shown in FIG. 6, taken along line 7-7.

In one example, as shown in FIGS. 3-4, the channel depth 67 may be greater than 0.5 millimeters and the channel width 61 may be greater than 5.0 millimeters. More particularly, the channel depth 67 may be from about 0.85 millimeters to about 1.3 millimeters and the channel width 61 may be from about 8.5 millimeters to about 10.0 millimeters. In another example, as shown in FIGS. 5-6, the channel depth 67 is greater than 0.5 millimeters and the channel width 61 may be greater than 5.0 millimeters. More particularly, the channel depth 67 may be from about 0.90 millimeters to about 1.3 millimeters and the channel width 61 may be from about 7.2 millimeters to about 10.0 millimeters.

In the example illustrated in FIGS. 5 and 6, the channel width 61 may vary along the channel length 50. As such, in the example illustrated in FIGS. 5 and 6, the channel width 61 may be defined as a first channel width 61*a* measured at a first measurement point and the channel width 61 may be further defined as a second channel width 61*b* measured at a second measurement point. In some examples, the first channel width 61*a* is greater than the second channel width 61*b*.

Accordingly, in such examples, as illustrated in FIGS. 5 and 6, each interior channel 34 may have a maximum channel aspect ratio and a minimum channel aspect ratio. The maximum channel aspect ratio may be defined as the ratio of the maximum channel width 61*a* (FIGS. 5 and 6) to the channel depth 67 measured at the first measurement point. Each interior channel 34 may further have a channel minimum aspect ratio. The channel minimum aspect ratio is defined as the ratio of the second channel width 61*b* to the channel depth 67 measured at the second measurement point. The channel maximum aspect ratio may be greater than the channel minimum aspect ratio. The channel maximum aspect ratio may be greater than the seam aspect ratio. The channel minimum aspect ratio may also be greater than the seam aspect ratio.

Further, each interior channel 34 may have a channel length 50. In the examples shown in FIGS. 3-6, the channel length 50 of each interior channel 34 may be from about 1.0 centimeters to about 27.0 centimeters. In one example, as shown in FIGS. 3-4, the channel length 50 of each interior channel 34 may be from about 1.0 centimeters to about 8.0 centimeters. In another example, as shown in FIGS. 5-6, the channel length 50 of each interior channel 34 may be from about 2.0 centimeters to about 27.0 centimeters.

The plurality of interior channels 34 may further define a second aggregate deboss length. The second aggregate deboss length is defined as a sum of all of the channel lengths 50. In some example embodiments, the second aggregate deboss length may be greater than 675 centimeters. More particularly, the second aggregate deboss length may be from about 690 centimeters to about 1000 centimeters. Even more particularly, the second aggregate deboss length shown in the example illustrated in FIGS. 3-4 may be from about 690 centimeters to about 750 centimeters, and the second aggregate deboss length shown in the example illustrated in FIGS. 5 and 6 may be form about 810 centimeters to about 1000 centimeters.

The sports ball 10 may further have an aggregate feature length, which is defined as the sum of the indentation lengths 45, 50, namely, the sum of the first aggregate deboss length (total sum of all seam lengths 45) and the second aggregate deboss length (total sum of all interior channel 34 lengths 50). In example embodiments, the aggregate feature length may be greater than 800 centimeters. In a non-limiting example, as illustrated in FIGS. 3 and 4, the aggregate feature length is from about 825 centimeters to about 900 centimeters, wherein the plurality of indentations 34, 38 cover or define approximately 48% to 51% of the exterior surface 13 of the cover 12. In another non-limiting example, as illustrated in FIGS. 5 and 6, the aggregate feature length is from about 950 centimeters to about 1150 centimeters, wherein the plurality of indentations 34, 38 to cover or define approximately 44% to 61% of the exterior surface 13 of the cover 12.

As evaluated via qualitative assessment based on visual observations, sports balls 10 having increased aggregate feature lengths, particularly those have aggregate feature lengths greater than 800 centimeters, have been found to provide aerodynamic consistency characteristics that are improved from conventional designs. Increased aggregate feature length and increased surface coverage of the exterior surface 13 by the indentations 34, 38 creates positive flight characteristics (consistency and length of trajectory) and enhances the aerodynamics of ball 10, i.e., reducing aerodynamic drag on the ball for better accuracy, consistency, and increased velocity.

When an example sports ball 10 maintains an aggregate feature length of greater than 800 centimeters and has 44%-61% of the exterior surface 13 occupied by the indentations 34, 38, it is more likely that the boundary layer of air surrounding the sports ball 10 in flight will undergo the transition from laminar flow to turbulent flow at a predetermined point. This forced alteration of the flow of air around the ball 10, e.g., tripping the boundary layer from laminar flow to turbulent flow at a predetermined point on the ball 10, increases lift on the ball 10 and promotes stability and consistency of the ball 10 in flight, which thereby reduces the likelihood of, for example, unwanted dip of the ball 10 during a driven shot on goal and/or unwanted wobble during flight.

However, if aggregate feature length and the percentage of surface coverage occupied by the indentations 34, 38 are increased beyond a critical point, such that the indentations 34, 38 do not maintain enough predefined distance 110, 112, 114 therebetween (FIG. 3-6), softness and ball feel characteristics may be diminished. As such, it is desirable to arrange the indentations 34, 38 on the exterior surface 13 in a topographical arrangement 56 to balance increased aggregate feature length and surface coverage of the exterior surface 13 by the indentations 34, 38 to enhance consistency and the aerodynamic properties of the ball 10 without sacrificing softness and ball feel characteristics.

Accordingly, each of the interior channels 34 is non-contiguous with and spaced apart from each of the other interior channels 34 by a first predefined distance 110, 112 and each of the plurality of interior channels 34 is non-contiguous with and spaced apart from each of the plurality of peripheral seams by at least a second predefined distance 114. Acceptable predefined distances 110, 112, 114 between channels 34, 38 to maintain desired softness and ball feel characteristics, i.e., Shore A hardness values softer than 59 A, shall be greater than 5.0 millimeters between two interior channels 34 (distances 110, 112) and greater than 10.0 millimeters between an interior channel and a peripheral seam 38 (distance 114). In one non-limiting example, illustrated in FIGS. 3-6, acceptable predefined distances 110, 112, 114 between channels 34, 38 may range from about 9.0 millimeters to about 25.0 millimeters. The predefined distances 110, 112, 114 are discussed in more detail herein below. The smaller the predefined distance 110, 112, 114 between two respective indentations 34, 38 the harder the ball surface at the respective measurement point.

The plurality of plateau sections 35, the plurality of peripheral seams 38, and the plurality of interior channels 34 cooperate to define topographical arrangement 56 across a majority of the exterior surface 13 of the cover 12. Further, in the example configurations shown in FIGS. 3-6, the orientation of the peripheral seams 38 and the interior channels 34 promotes a balanced and substantially symmetrical design across the exterior surface 13 ball 10.

The balanced topographical designs 56, as shown by example in FIGS. 3-6, avoids uneven lift of the ball 10 and improves consistency of the ball 10 when kicked in any orientation. As such, a balanced topographical design 56, such as those shown in FIGS. 3-6, allows the ball 10 to fly or travel the substantially the same regardless of the orientation of the ball 10 when kicked. Ball 10 consistency is one property that is often commented on by players. The most consistent balls are the ones with the optimum combination of amplitude and frequency of the varying force coefficients relative to the amount of spin. As such, the tailoring of the topographical design 56 on the ball 10 may allow for optimization of consistency and improved aerodynamics.

Further referring to FIGS. 3-6, the topographical design 56 may be composed of predefined panel arrangements 75, 76. Each predefined panel arrangement 75, 76 may be comprised of a plurality of sub-panel arrangements 71.

In an example twelve panel ball 10, the topographical design 56 may be comprised of six pairs of predefined panel arrangements 75, 76. In this example, corresponding panel arrangements 75, 76 would be disposed opposite one another on the ball 10, when the respective panels 28 are coupled at the peripheral seams 38. In an example four panel ball 10, wherein each panel 28 is essentially comprised of three conventional pentagon-shaped panels of a conventional twelve panel ball 10, each of the four panels 28 contains a plurality of sub-panel arrangements 71 positioned in a specified orientation on three respective panel sections 73, 77, 79.

More particularly, referring to FIGS. 3-6 the ball 10 is composed of four panels 28. The sub-panel arrangement 71 is disposed in a first orientation on a first panel section 73. The sub-panel arrangement 71 is then rotated approximately 120 degrees in a specified rotational direction R from the first orientation to a second orientation and disposed on the second panel section 77 in the second orientation. The sub-panel arrangement 71 may then be rotated again approximately an additional 120 degrees in a specified rotational direction R from the second orientation to a third orientation, and disposed upon a third panel section 79 in the third orientation.

In the four-panel ball 10 examples of FIGS. 3-6 the panels 28 may be coupled, such that the orientation of the peripheral seams 38 and interior channels 34 promotes a balanced design across the exterior surface 13 ball 10. Said another way, the design is both balanced and symmetrical in that each panel 28 defines substantially the same number of plateau section 35, peripheral seams 38, and interior channels 34 as each of the other panels 28. Moreover, each peripheral seam 38 present on one portion of the ball 10 has a corresponding opposite peripheral seam 38 disposed opposite thereof on the exterior surface 13 of the ball. Likewise, each interior channel 34 present on one portion of the ball 10 has a corresponding opposite debossed feature 34 disposed opposite thereof of the ball 10 (FIG. 3A).

More particularly, in this way, the inflatable sports ball 10 has an interior center C and the interior center C is positioned on a central axis A, as shown in FIG. 3A. As shown in FIG. 3A, the plurality of interior channels 34 may further comprise a first interior channel 34*a* and a second interior channel 34*b*. The first interior channel 34*a* is at least partially disposed on the central axis A and the second interior channel 34*b* is likewise at least partially disposed on the central axis A, such that the first interior channel 34*a* is positioned directly opposite the second interior channel 34*b* upon the exterior surface 13 of the ball 10. The first interior channel 34*a* may be of a predefined shape and the second interior channel 34*b* may be of the same predefined shape, such that the second interior channel 34*b* is substantially similar to or even identical to the first interior channel 34*a*.

With reference to the example configurations of topographic designs 56 shown in FIGS. 3-6, each of the plurality of interior channels 34 may be provided within a central region of one or more of the panels 28. The interior channels 34 further divide the exterior surface into a plurality of open polygonal portions 54, such that each interior channel comprises at least a portion of at least one side of at least one of the open polygonal portions. The plurality of plateaus sections 35 may be disposed between the interior channels 34.

By way example, in FIGS. 3-6, open pentagons are shown. In this way, each of the open polygonal portions 54, if closed, would have a total of five or more sides, i.e., be defined by five or more interior channels 34. As such, in the example configurations of FIGS. 3-6, each open polygonal portion 54 is an open polygon rather than a closed polygon. As such, each open polygonal portion 54 is missing at least a portion of at least one side.

As shown by example in FIG. 3-4, the topographical design 56 may be composed of a plurality of predefined panel arrangements, wherein a predefined panel arrangement 76 is defined as the orientation of the plateau sections 35 and the interior channels 34 on each of the respective panels 28. Each predefined panel arrangement 76 may be comprised of a plurality of sub-panel arrangements 71. In the examples shown in FIGS. 3-4, the topographical design 56 is composed of a plurality of panels 28, namely, four panels, each having the same predefined panel arrangement 76. The predefined panel arrangement 76 is composed of three substantially similar sub-panel arrangements 71 as detailed herein above.

In the non-limiting example illustrated in FIGS. 3-4, the open polygonal portions 54 may be arranged in a concentric arrangement. In such an example configuration, the plurality of open polygonal portions 54 comprises at least a first open polygonal portion 55 comprising of a first plurality of interior channels 81 and a second open polygonal portion 57 comprising a second plurality of interior channels 83. Each of the interior channels 34 of the first plurality of interior channels 81 is non-contiguous with and spaced apart from each of the other interior channels 34 of the first plurality of interior channels 81, by the predetermined distance 110. Each of the interior channels 34 of the second plurality of interior channels 83 is non-contiguous with and spaced apart from each of the other interior channels 34 of the second plurality of interior channels 83 by the predetermined distance 110. Further, each of the interior channels 34 of the second plurality of interior channels 83 is non-contiguous with and spaced apart from each of the interior channels 34 of the first plurality of interior channels 81 by the predefined distance 112. Each of the interior channels 34 is non-contiguous with and spaced apart from each of the peripheral seams 38 by the predefined distance 114. The predetermined distance 110 may be greater than 9.0 millimeters. The predetermined distance 112 may be from about 9.5 millimeters to about 12.0 millimeters. The predetermined distance 114 may be from about 10.0 millimeters to about 11.0 millimeters.

As illustrated in FIGS. 5-6, the topographical design 56 may be composed of a plurality of predefined panel arrangements, wherein a predefined panel arrangement 75 is defined as the orientation of the plateau sections 35 and the interior channels 34 on each of the respective panels 28. Each predefined panel arrangement 75 may be comprised of a plurality of sub-panel arrangements 71. In the non-limiting examples illustrated in FIGS. 5-6, the topographical design 56 is composed of a plurality of panels 28, namely, four panels, each having the same predefined panel arrangement 75. The predefined panel arrangement 75 is composed of three substantially similar sub-panel arrangements 71.

As illustrated in FIGS. 5-6, each sub-panel arrangement 71 may include interior channels 34 and the open polygonal portions 54 divided into a first channel grouping 102 and a second channel grouping 104. Each channel 34 within the first channel grouping 102 comprises a chevron element 91 and further comprises a pair of opposing extension portions 106, 108, namely, a first extension portion 106 and a second extension portion 108. Each chevron element 91 includes a first section 93 and a second section 94, each disposed between the respective first boundary 87 and second boundary 89. The first section 93 has a first section central end 92 and a first section distal end 95. The second section 94 has a second section central end 96 and a second section distal end 97. The first section central end 92 is connected to the second section central end 96 at a chevron angle 100. The chevron angle 100 is greater than 90 degrees and less than 180 degrees. Accordingly, the first section 93 is obliquely angled with respect to the second section 94.

The first extension portion 106 is joined to the first section 93 at the first section distal end 95 and extends toward the panel limit 39. The first extension portion 106 is obliquely angled with respect to the first section 93, and forms a first extension angle 107 with the first section 93. The first extension angle 107 is less than 180 degrees. The second extension portion 108 is joined to the second section 94 at the second section distal end 97 and extends toward to the panel limit 39. The second extension portion 108 is obliquely angled with respect to the second section 94, and forms a second extension angle 109 with the second section 94. The second extension angle 109 is less than 180 degrees. The second extension angle 109 is substantially similar to the first extension angle 107, such that a measure of the first extension angle 107 is equal to a measure of the second extension angle 109.

Each of the interior channels 34 within the second channel grouping 104 comprises a chevron element 91. The chevron elements 91 of the interior channels 34 within the second channel grouping 104 are disposed between and oriented transverse to each of the first extension portions 106 and second extension portions 108 of the respective interior channels 34 of the first channel grouping 102. The transverse orientation of the chevron elements 91 of the interior channels 34 within the second channel grouping 104 with respect to each of the first extension portions 106 and second extension portions 108 of the respective interior channels 34 of the first channel grouping 102 promotes uniform consistency of the overall topographical arrangement 56 of the interior channels 34, seams 38, and the plateau sections 35 across a majority of the exterior surface 13 of the cover 12.

The chevron elements 91 of the first channel grouping 102 are closer to the panel center 37 than the chevron elements 91 of the second channel grouping 104 are to the panel center 37. Accordingly, the chevron elements 91 of the second channel grouping 104 are closer to the panel limit 39 than the chevron elements 91 of the first channel grouping 102 are to the panel limit 39.

As such, each respective sub-panel arrangement 71 comprises an alternating and repeating series of plateau sections 35 and chevron elements 91 extending between the panel center 37 and the panel limit 39. The respective sub-panel arrangements 71 may comprise from about eight plateau sections 35 and seven corresponding chevron elements 91 to about eleven plateau sections 35 and ten corresponding chevron elements 91. In the example shown in FIGS. 5 and 6, the respective sub-panel arrangements 71 comprise an alternating and repeating series of eight plateau sections 35 and seven chevron elements 91.

As shown by example in FIGS. 5 and 6, in this way, each respective sub-panel arrangement 71 includes a first interior channel 116 having a first chevron element 91*a*, the first chevron element having a first chevron angle 100*a*. Further the first interior channel 116 is part of the first channel grouping 102 and has a first interior channel first extension portion 106*a* and a first interior channel second extension portion 108*a*. The first interior channel first extension portion 106*a* and the first interior channel second extension portion 108*a* are joined to the first section distal end 95 and the second section distal end 97 of the respective chevron element 91*a* and extend toward the panel limit 39. The first chevron element 91*a* of the first interior channel 116 is proximate to the panel center 37, namely closer to the panel center 37 than the panel limit 39.

Each of respective sub-panel arrangement 71, as illustrated in FIGS. 5 and 6, may further include at least a second interior channel 118. The second interior channel 118 comprising a second chevron element 91*b* having a second chevron angle 100*b*. The second chevron element 91*b* is disposed between and oriented transverse to each of the first channel extension portions 106*a*, 108*a* of the first channel 116. The second chevron element 91*b* is further disposed proximate to the panel limit 39, namely closer to the panel limit 39 than the panel center 37.

While the chevron angle 100 is always greater than 90 degrees and less than 180 degrees, the chevron angle 100 gets larger or more obtuse as the chevron elements 91 move from the panel center 37 to the panel limit 39. As such, the first chevron angle 100*a* is more acute that the second chevron angle 100*b*. Said another way, the first chevron angle 100*a* is smaller than the second chevron angle 100*b*.

Each of the interior channels 34 of the first channel grouping 102 is non-contiguous with and spaced apart from each of the other interior channels 34 of the first channel grouping by the predetermined distance 110. Each of the interior channels 34 of the second channel grouping 104 is non-contiguous with and spaced apart from each of the other interior channels 34 of the second channel grouping by the predetermined distance 110. Further, each of the interior channels 34 of the second channel grouping 104 is non-contiguous with and spaced apart from each of the interior channels 34 of the first channel grouping 102 by the predefined distance 112. Each of the interior channels 34 is non-contiguous with and spaced apart from each of the peripheral seams 38 by the predefined distance 114. The predetermined distance 110 is greater than 9.0 millimeters. The predetermined distance 112 is from about 14.0 millimeters to about 16.0 millimeters. The predetermined distance 114 is from about 10.0 millimeters to about 11.0 millimeters.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An inflatable sports ball comprising:

an interior bladder;

a cover disposed about the interior bladder, the cover comprising a plurality of adjoining panels and defining: an exterior surface;

a plurality of peripheral seams disposed between adjoining ones of the plurality of adjoining panels that extend radially inward from the exterior surface of the cover, wherein each peripheral seam has a seam width, seam length, and a seam terminus radially spaced apart from the exterior surface by a seam depth, wherein the plurality of peripheral seams has a first aggregate deboss length wherein the first aggregate deboss length is defined as a sum of all the seam lengths;

a plurality of interior channels extending radially inward from the exterior surface of the cover, each interior channel defining a debossed feature provided within a central region of one or more of the plurality of panels, such that each of the interior channels is non-contiguous with and spaced apart from each of the other interior channels by a first pre-defined distance and each of the interior channels is non-contiguous with and spaced apart from each of the peripheral seams by a second pre-defined distance, wherein each interior channel comprises:

a channel length, a channel depth, and a channel terminus radially spaced apart from the exterior surface by the channel depth, wherein the plurality of interior channels has a second aggregate deboss length defined as a sum of all the interior channel lengths;

a chevron element having a first boundary and a second boundary such that a channel width is disposed between the first boundary and the second boundary, the chevron element further comprising a first section having a first section central end and a first section distal end and a second section having a second section central end and a second section distal end, wherein the first section central end is connected to the second section central end at a chevron angle that is greater than 90 degrees and less than 180 degrees, such that the first section is obliquely angled with respect to the second section;

wherein the cover has an aggregate feature length that is defined as a sum of the first aggregate deboss length and the second aggregate deboss length, and wherein the aggregate feature length is greater than about 800 centimeters;

wherein the plurality of interior channels comprises a first channel grouping and a second channel grouping;

each interior channel of the first channel grouping comprises the chevron element, a first extension portion, and a second extension portion, wherein the first extension portion is connected to the first section distal end of the respective chevron element at a first extension angle and the second extension portion is connected to the second section distal end of the respective chevron element at a second extension angle;

the first extension angle is less than 180 degrees, such that the first extension portion is obliquely angled with respect to the first section of the respective chevron element;

the second extension angle is less than 180 degrees, such that and the second extension portion is obliquely angled with respect to the second section of the respective chevron element; and a measure of the first extension angle is identical to a measure of the second extension angle.

2. The inflatable sports ball of claim 1 wherein the chevron elements of the second channel grouping are disposed between the first extension portions and the second extension portions of the respective channels of the first channel grouping.

3. The inflatable sports ball of claim 2 wherein each of the adjoining panels has a panel center and a panel limit; and wherein the chevron elements of the first channel grouping are closer to the panel center than the chevron elements of the second channel grouping are to the panel center; and wherein the chevron elements of the second channel grouping are closer to the panel limit than the chevron elements of the first channel grouping are to the panel limit.

4. The inflatable sports ball of claim 3 wherein:

the first channel grouping comprises a first interior channel having a first chevron element having a first chevron angle, a first interior channel first extension portion, and a first interior channel second extension portion;

the second channel grouping comprises a second interior channel having a second chevron element having a second chevron angle;

the second chevron element is disposed between the first interior channel first extension portion and the first interior channel second extension portion, the second chevron element being further disposed closer to the panel limit than the panel center; and the first chevron angle is more acute that the second chevron angle.

5. The inflatable sports ball of claim 4 wherein:

the channel width is defined as a first channel width at the chevron angle;

the channel width is defined as a second channel width at the first section distal end and the second section distal end of the respective chevron element; and the first channel width is greater than the second channel width.

6. The inflatable sports ball of claim 5 wherein:

each peripheral seam has a seam maximum aspect ratio, wherein the seam maximum aspect ratio is defined as a ratio of the seam width to the seam depth;

each interior channel having a channel maximum aspect ratio and a channel minimum aspect ratio, wherein the channel maximum aspect ratio is defined as a ratio of the first channel width to the channel depth measured at the chevron angle and the channel minimum aspect ratio is defined as a ratio of the second channel width to the channel depth measured at at least one of the first section distal end and the second section distal end of the respective chevron element;

the channel maximum aspect ratio is greater than the seam maximum aspect ratio; and the channel maximum aspect ratio is greater than the channel minimum aspect ratio of each channel.

7. The inflatable sports ball of claim 1 wherein:

the cover has an aggregate feature length that is defined as a sum of the first aggregate deboss length and the second aggregate deboss length;

the aggregate feature length is from about 800 centimeters to about 1200 centimeters;

the first aggregate deboss length is from about 138 centimeters to about 142 centimeters; and the second aggregate deboss length is greater than 675 centimeters.

8. The inflatable sports ball of claim 1 wherein the first predefined distance is greater than about 5.0 millimeters, wherein the second predefined distance is greater than about 10.0 millimeters.

9. The inflatable sports ball of claim 1 wherein the channel depth is greater than about 0.85 millimeters.

* * * * *